United States Patent [19]

Roberts et al.

[11] Patent Number: 5,058,897

[45] Date of Patent: Oct. 22, 1991

[54] OIL COMMODITY BOARD GAME

[76] Inventors: Ray E. Roberts; Joshua B. Roberts, both of 500 W. Oak, El Reno, Okla. 73036

[21] Appl. No.: 581,912

[22] Filed: Sep. 13, 1990

[51] Int. Cl.[5] ..... A63F 3/00

[52] U.S. Cl. ..... 273/278

[58] Field of Search ..... 273/256, 275, 278, 276

[56] References Cited

U.S. PATENT DOCUMENTS

| | | | |
|---|---|---|---|
| 1,760,287 | 5/1930 | Schippers | 273/278 |
| 2,299,803 | 10/1942 | Deaton | 273/278 |
| 3,729,198 | 4/1973 | Shaffer . | |
| 3,844,567 | 10/1974 | Marker . | |
| 3,907,310 | 9/1975 | Adcock et al. | 273/278 |
| 4,025,075 | 5/1977 | Priska et al. . | |
| 4,190,256 | 2/1980 | Rudden, Jr. | 273/275 |
| 4,384,721 | 5/1983 | Dolansky | 273/278 X |
| 4,394,019 | 7/1983 | Anthony et al. | 273/256 |
| 4,615,527 | 10/1986 | Moss | 273/278 |
| 4,779,874 | 10/1988 | Dykstra et al. | 273/278 X |

FOREIGN PATENT DOCUMENTS

| | | | |
|---|---|---|---|
| 2066087 | 7/1981 | United Kingdom | 273/256 |

*Primary Examiner*—Edward M. Coven
*Assistant Examiner*—William E. Stoll

[57] ABSTRACT

Game apparatus that includes a game board having markings thereon representing an imaginary oil well, a number of imaginary oil storage tanks and water storage tanks, and an imaginary channel extending from the imaginary oil well to the different imaginary storage tanks. A number of separate miniature flow line section pieces are adapted to be placed onto the different channels to form imaginary flow lines between the oil well and the various storage tanks. During the playing of the game die are rolled to establish prices for selling oil form the oil storage tanks or for disposing of water from the water storage tanks. Play money is exchanged to determine the game winner, i.e. the player acquiring the most money.

3 Claims, 1 Drawing Sheet

OIL COMMODITY BOARD GAME

BACKGROUND AND SUMMARY OF THE INVENTION

This invention relates to a game based broadly on oil well operation principles. The game apparatus includes a square game board having an imaginary oil well marked at the board central axis. Four printed courses (paths) extend diagonally along the board surface from the imaginary oil well toward corner areas of the board. Each corner area of the board is marked to designate an imaginary oil storage tank and an imaginary water storage tank.

The game can be played by two, three or four players. Each player has ownership of one corner of the game board, i.e. an oil storage tank and associated water storage tank. Each of the four diagonal courses on the board surface is adapted to receive therein a number of elongated pieces that simulate sections of a flow line. Terminal ends of these pieces are configured as male and female connectors adapted to interlock with connectors on the terminal ends of other pieces.

During the playing of the game each player rolls a die to acquire miniature simulated oil well tubing and pump rods. The simulated tubing and pump rods are exchanged for the aforementioned simulated flow line pieces, which can be used to establish an imaginary flow line between the well and each player's player station (oil storage tank and water storage tank), i.e. a tank battery.

After each player has established the necessary imaginary flow line he/she can roll another die to fill the two simulated storage tanks. The die can also be rolled to establish a selling price for oil accumulated in his/her oil storage tank, and to establish a dollar cost for the disposal of water accumulated in his/her water storage tank. The winner of the game is the person who has accumulated the most money in a predetermined time period, or the first person to accumulate a given amount of money.

The nature of the game will become clearer by referring to the following specification and attached drawing.

THE DRAWINGS

DESCRIPTION OF A PREFERRED EMBODIMENT OF THE INVENTION

Figure 1:
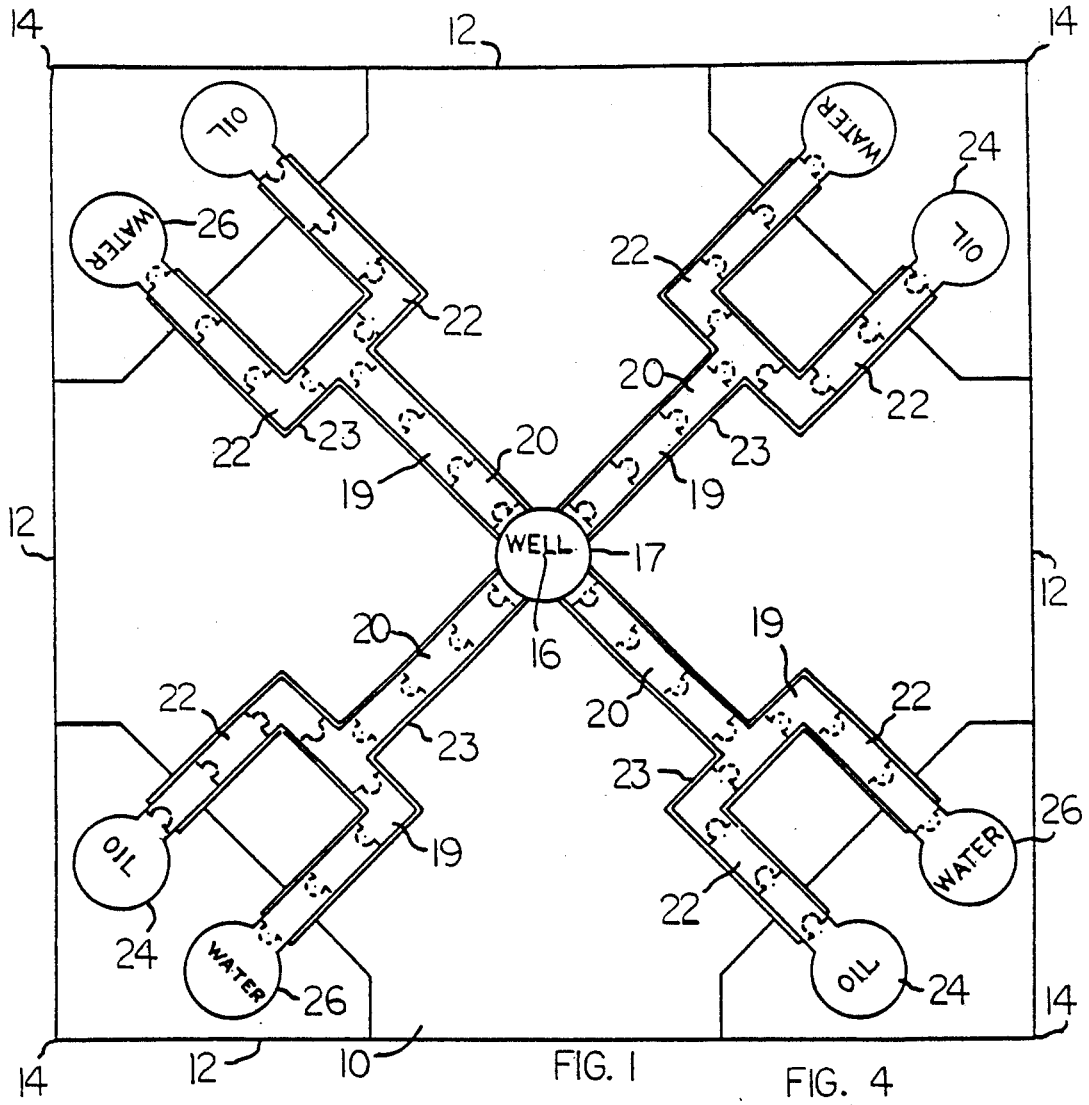
FIG. 1 is a top plan view of a game board employed in a game conceived according to the invention.

FIG. 1 shows a flat game board 10 having a square plan cross section. The board has four straight edges 12 that form four corners 14 equidistant from a central board axis 16. The board is marked to indicate an imaginary oil well 17 centered on axis 16.

Radiating diagonally outwardly from well 17 toward corners 14 of the board are four printed flow lines (channels) designated generally by numeral 19. Each flow line (channel) includes a main section 20 and two branch sections 22. Each branch section has an L-shaped configuration, that includes a short leg extending at right angles to main section 20 and a long leg extending parallel to the main section.

Figure 4:
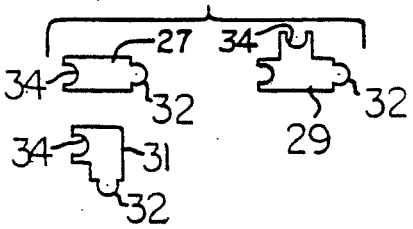
FIG. 4 is a view of three flow line-simulating pieces used with the FIG. 1 game board.

The board surfaces defining the boundaries of each channel 19 can be printed on the board surface to form locator surfaces for the flow line pieces shown in FIG. 4. These channel boundary areas are indicated by double lines 23 in FIG. 1.

Each corner of the board is marked to designate a player station that includes an imaginary oil storage tank 24 and an imaginary water storage tank 26. The board is oriented so that each player has a corner area of the board in front of him/her. The player "owns" the associated storage tanks 24 and 26.

One object of the game is for each respective player to establish an imaginary flow line between central well 17 and his/her storage tanks 24 and 26. Each channel 19 has markings thereon indicating areas designed to receive the individual flow line section pieces shown in FIG. 4. There are three different flow line section configurations, namely a straight section designated by numeral 27, a T-section designated by numeral 29, and an L-shaped elbow section designated by numeral 31. Each piece has a length that is at least twice its width. The terminal ends of the various pieces are configured as male connectors 32 and female connectors 34. When the various pieces are placed in channel 19 the terminal ends of the pieces interlock to hold the pieces in place in the channel.

Figure 2:
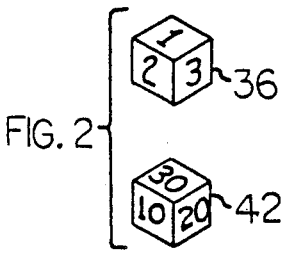
FIG. 2 is a perspective view of two dice used with the FIG. 1 game board.
Figure 3:
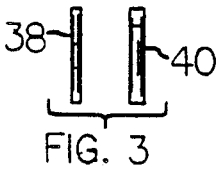
FIG. 3 is a view of a simulated pump rod and well tubing used with the FIG. 1 game board.

Each player attempts to acquire the pieces shown in FIG. 4 by rolling a die 36 (FIG. 2). That die has three faces colored green, and three faces colored yellow. Each green face has the number 1, 2 or 3 thereon; similarly each yellow face has the number 1, 2 or 3 thereon. When a person rolls die 36 to show a yellow face he/she receives the appropriate number of pump rods 38 (FIG. 3); when the person rolls the die to show a green face he/she receives the appropriate number of well tubings 40 (FIG. 3). The simulated pump rod and tubing may be of different diameters and of distinctively different colorings to differentiate the rod from the tubing.

Each player rolls die 36 in turn, one player after another. Each time the die is rolled the respective player receives the appropriate number of rods 38 or tubes 40. These rods and tubes are later traded in for the flow line section pieces 27, 29 or 31 according to the following schedule: six rods or six tubes for each straight piece 27, nine rods or eight tubes for each elbow piece 31, and fifteen rods or fourteen tubes for a T-section piece 29.

As the individual players acquire various pieces 27, 29 and 31 they place them in their respective channels 19 to establish an imaginary flow line between well 17 and the respective storage tanks 24 and 26. After each player has established such a flow line he/she then begins a new phase or stage in the game. This new phase involves the acquisition, disposal and selling of oil and water into or out of his/her storage tanks 24 and 26. The players do not necessarily embark on this second stage at the same point in time. One player can still be attempting to establish his/her flow line (in channel 19) while another player is embarking on the second stage of the game.

Figure 5:
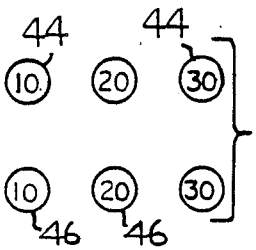
FIG. 5 shows circular disks having numerical values for imaginary oil and water accumulated in the respective storage tanks marked on the FIG. 1 game board.

During the second stage of the game the player rolls another die 42 (FIG. 2). This die has three faces colored green, a and three other faces colored yellow. Each green face has the number 10, 20 or 30 thereon; similarly each yellow face has the number 10, 20 or 30 thereon. The green faces represent barrels of oil, whereas the yellow faces represent barrels of water. When a player rolls a die 42 to show a green face with "20" thereon, he/she thereby acquires twenty barrels of oil in his/her respective storage tank 24. At that point in the game the player is required to place the appropriately marked green disk 44 (FIG. 5) at his/her oil storage tank 24. If the player had rolled die 42 to show a yellow with a "30" thereon he/she would be required to place the appropriately marked yellow disk 46 at his/her water storage tank 26. The numbers on the disks can be added together to show how many barrels are in the respective tank 24 or 26 at any one time.

An aim of the game is for each player to acquire as much oil as possible in his/her tank 24, while acquiring as little water as possible in his/her tank 26. Each player is permitted to sell the oil at a profit; each player is required to dispose of the water at a loss. The profit-loss relationship dictates the assets owned by the player. The player having the most assets (money) at the end of the game can be declared the game winner.

Figure 6:
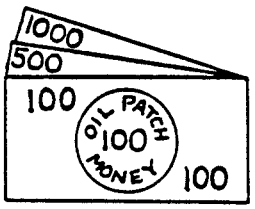
FIG. 6 shows a representative piece of play money used with the FIG. 1 game board.

During the playing of the game each player is at any point in time limited to one hundred barrels of oil or water in the respective tank 24 or 26. If the limit is at anytime exceeded, the player is required to pay a dollar penalty (e.g. $1,000) to each other player. FIG. 6 shows representative pieces of paper money that can be used in playing the game. The normal flow of money is from a player to the bank, or from the bank to the player (not from one player to another player).

During the second stage of the game each player announces at the start of his turn whether he/she is acquiring or selling (oil or water); the decision will in part be affected by the amount of oil or water in his/her storage tanks 24 and 26. If there happens to be a large accumulation in each tank (e.g. 80 barrels) the player will likely announce a decision to sell, in order to avoid the $2,000 penalty associated with possible over fill of the tank that would result from a decision to roll die 42 in the "acquisition" mode.

Assuming the player decides to sell oil (or dispose of water) he will announce at the start of his turn, e.g. "I am going to sell oil" or "I am going to dispose of water". The player then rolls die 42 to determine the price per barrel he/she is to receive (or pay) for the transaction; at that time the player announces how many barrels is to be sold or disposed of. If the player elects to sell 30 barrels of oil, and die 42 shows the number "20" (green or yellow) he/she will receive from the bank $600, i.e. 30 barrels multiplied by twenty dollars per barrel. If the player had elected to dispose of 60 barrels of water, he/she would have been required to pay to the bank $1,200, i.e. 60 barrels multiplied by twenty dollars per barrel.

Money is passed between the player and the bank, according to the transaction resulting from each player's turn. Also, the appropriate disks 44 or 46 are added to, or removed from, the player's station, according to the nature of the transaction. Each player's turn results in some sort of transaction (exchange of money and transfer of yellow or green disks 46, 44). The game is played, either for a predetermined time period, or until one player acquires a predetermined amount of money (e.g. $10,000).

Various changes and modifications may be employed in practice of the invention. For example, each die 36 or 42 can be replaced with a spinner device having the appropriate coloring and numbers thereon.

We claim:

1. Game apparatus comprising a flat surfaced game board having a central axis and a peripheral edge; markings on the board surface centered on said central axis to represent an oil well; markings at the peripheral edge of the board defining at least four equidistant player stations, each station including markings denoting an oil storage tank and a water storage tank; means defining a flow-line between the oil well and each player station; each flow line means including a main section extending from the well, and two branch sections extending between the main section and the respective storage tanks; and a number of separate miniature flow line section pieces installable on each flow line; each piece having a width dimension corresponding to the width dimension of the flow line and a length dimension at least twice the width dimension; some of said pieces being straight linear pieces representing straight flow line sections; some of said pieces being L-shaped pieces representing pipe elbows; some of said pieces being T-shaped pieces representing pipe T sections; said pieces having predetermined lengths whereby the pieces can be placed in a predetermined order in each defined channel to form a continuous simulated flow line between the central well and the respective storage tanks.

2. The game apparatus of claim 1, wherein said game board has a square plan configuration, whereby the board has four corners and four connecting side edges; each player station being located in a corner area of the board; each flow line including a main section located on a diagonal line directed from the board central axis toward a corner area of the board, and two L-shaped branch sections having legs thereof extending parallel to said diagonal line and equidistant therefrom.

3. The game apparatus of claim 2, wherein each said piece has at least two terminal ends configured as male and female connectors adapted for interlocking engagement with connectors on associated pieces.

* * * * *